US005423478A

United States Patent [19]

Roosa

[11] Patent Number: 5,423,478

[45] Date of Patent: Jun. 13, 1995

[54] TAKEOUT CONTAINER WITH INTEGRAL HANDLES

[75] Inventor: Paul D. Roosa, West Hurley, N.Y.

[73] Assignee: International Paper Company, Purchase, N.Y.

[21] Appl. No.: 255,856

[22] Filed: Jun. 7, 1994

[51] Int. Cl.[6] ..... B65D 5/462

[52] U.S. Cl. ..... 229/117.15; 229/114; 229/117.14

[58] Field of Search ..... 229/114, 117.14, 117.15, 229/117.22

[56] References Cited

U.S. PATENT DOCUMENTS

| | | | |
|---|---|---|---|
| 698,266 | 4/1902 | Elliott . | |
| 1,987,063 | 9/1933 | Hinton . | |
| 1,997,343 | 4/1935 | Quagliotti . | |
| 2,323,782 | 7/1943 | Kretchmer | 229/117.15 |
| 2,351,207 | 6/1944 | Henderson . | |
| 2,603,923 | 7/1952 | Chidsey, Jr. | 229/117.14 |
| 2,693,310 | 11/1954 | Stopper | 229/117.22 |
| 2,805,019 | 9/1957 | Muhs et al. | 229/117.15 |
| 2,869,770 | 1/1959 | Bass | 229/117.15 |
| 2,875,943 | 3/1959 | Cooper . | |
| 2,916,195 | 12/1959 | Gatward . | |
| 3,377,015 | 4/1968 | Moreno . | |
| 4,003,515 | 1/1977 | Steele . | |
| 4,017,019 | 4/1977 | Booth . | |
| 4,518,115 | 5/1985 | Sedwick | 229/117.22 |
| 5,284,294 | 2/1994 | Floyd | 229/117.15 |

FOREIGN PATENT DOCUMENTS

| | | | |
|---|---|---|---|
| 1247569 | 12/1988 | Canada | 229/117.15 |
| 769722 | 8/1934 | France | 229/117.15 |
| 2253123 | 5/1974 | Germany | 229/117.15 |
| 72865 | 12/1947 | Norway | 229/117.15 |
| 86040 | 4/1936 | Sweden | 229/117.15 |
| 1355441 | 6/1974 | United Kingdom | 229/117.14 |

*Primary Examiner*—Gary E. Elkins
*Attorney, Agent, or Firm*—Paul R. Juhasz

[57] ABSTRACT

A pyramidal, truncated container is fashioned from a unitary blank of paperboard. The inner two of four top closure panel each carry a semicircular handle cut from the blank and extend upwardly in surface contact with each other to form a two ply handle. The outer two of four top closure panels carry respective slits which fold over and become aligned and receive the handles. The free edge of the topmost inner top closure panels is provided with two spaced slots each of which receives a respective lower end of the two ply handle. The paperboard material on both sides of each of these slots extends beyond the free end of the bottommost inner top closure panel. The ends of the slits and the ends of the handles resiliently and frictionally engage each other to effect a firm top closure sealing action. The container exhibits special utility as a carry out container for food.

7 Claims, 3 Drawing Sheets

TAKEOUT CONTAINER WITH INTEGRAL HANDLES

BACKGROUND OF THE INVENTION

This invention relates to a container fashioned from a unitary blank of paperboard. The container is characterized by four top closure forming panels which lie on top of one another, with two opposite of said top closure panels carrying handles and the other two top closure panels having aligned slits which receive the handles. The art is aware of constructions of a somewhat similar type, such as shown in U.S. Pat. Nos. 1,997,343 issued to Quagliotti and 1,987,063 issued to Hinton. One drawback of known containers of this type is the difficulty of maintaining the top closure in a closed condition. In Hinton, projecting lips 5c and 7c are employed for this purpose, while in Quagliotti lacking flaps 1 are employed.

SUMMARY OF THE INVENTION

According to the practice of this invention, a unitary blank of paperboard is provided with fold lines for forming side walls, bottom closure panels, and top closure panels. The carton is erected by folding and glueing the side walls and the bottom closure panels to form a carton open at the top. The upper ends of the carton sidewalls are provided with closure panels, with each sidewall having a respective closure panel. Two opposite closure panels are provided with flat handles, cut from the blank, while the remaining two opposite panels are provided with slits which fold sequentially down, over the handles, to form an easily carried carton. The handles are semicircular and are of a diameter slightly in excess of the length of the slits so that upon folding the slitted top closure panels down, the ends of the slits frictionally engage the handle ends, firmly securing the top closure panels.

The container is particularly adapted to receive fast foods, such as Chinese food, and has the advantage that no metal wire handle is employed, to thus permit the carton contents to be reheated in a microwave oven.

The construction of the container of this invention permits it to hold liquids and also permits it, by virtue of its truncated pyramidal shape, to nest with other containers of the same construction prior to filling and closing. Further, the carton is easily reclosed after an initial opening.

DETAILED DESCRIPTION OF THE DRAWINGS

DETAILED DESCRIPTION OF THE INVENTION

Figure 1:
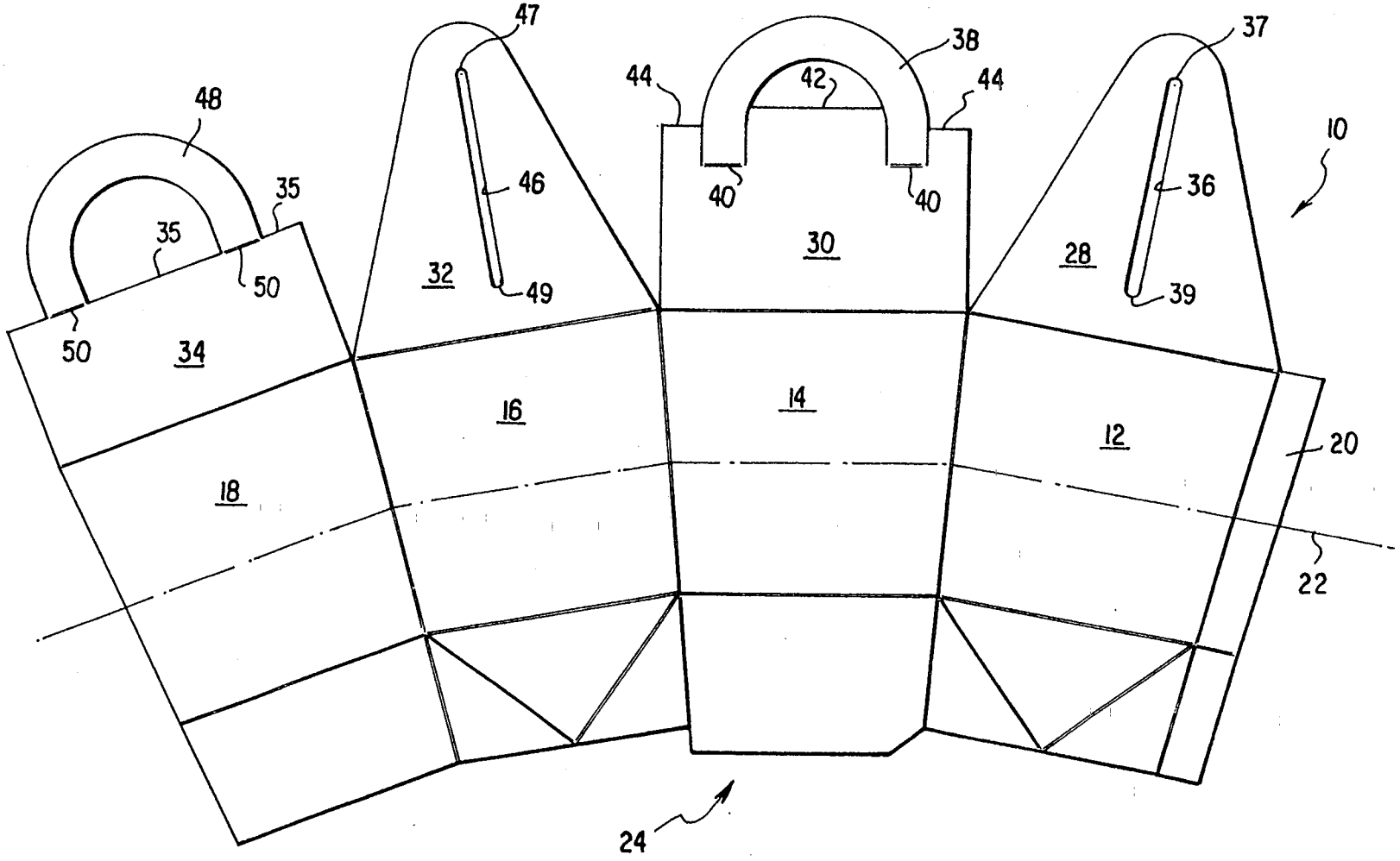
FIG. 1 is a plan view of a unitary blank of paperboard or other stiff, foldable, and resilient sheet material for forming the container of this invention.

Referring now to FIG. 1, a unitary blank of paperboard is denoted as 10. The edges of trapezoidal sidewall forming panels 12, 14, 16, and 18 are foldably and serially connected through the indicated generally vertical fold lines and along segmented axis 22. One of the end panels, such as panel 12, is provided with a manufacturer's flap 20. As viewed at FIG. 1, the lower portions of each of the sidewall panels are provided with respective panels 24 which may be of any conventional bottom closure construction.

Generally triangular top closure panel 28 is foldably secured to the upper edge of sidewall panel 12 by the indicated fold line. Similarly, generally rectangular top closure panel 30 is foldably secured to the top of sidewall panel 14 by the indicated fold line. Another triangular top closure panel 32 is secured by a fold line to the top of sidewall panel 16, while generally rectangular top closure panel 34 is foldably secured by the indicated fold line to the top of sidewall panel 18. Panel 28 is provided with a generally vertically extending elongated slit 36 having ends 37 and 39. Closure panel 30 carries an integral curved handle 38 whose ends are secured by fold lines 40 to spaced upper portions of panel 30. Closure panel 30 includes a central top free edge 42 and laterally adjacent top free edges 44, the latter edges spaced from each other, with the ends of handle 38 extending down to fold lines 40 through the indicated cut lines in the upper portion of closure panel 30. Triangular closure panel 32 is provided with a generally vertically extending elongated slit 46, similar to slit 36 of panel 28, with slit 46 having an upper end 47 and a lower end 49. Closure panel 34 is provided with a handle 48, similar to handle 38 of closure panel 30, with the lower ends of 48 having spaced fold lines 50. Panel 34 includes spaced free edge portions 35.

Figure 2:
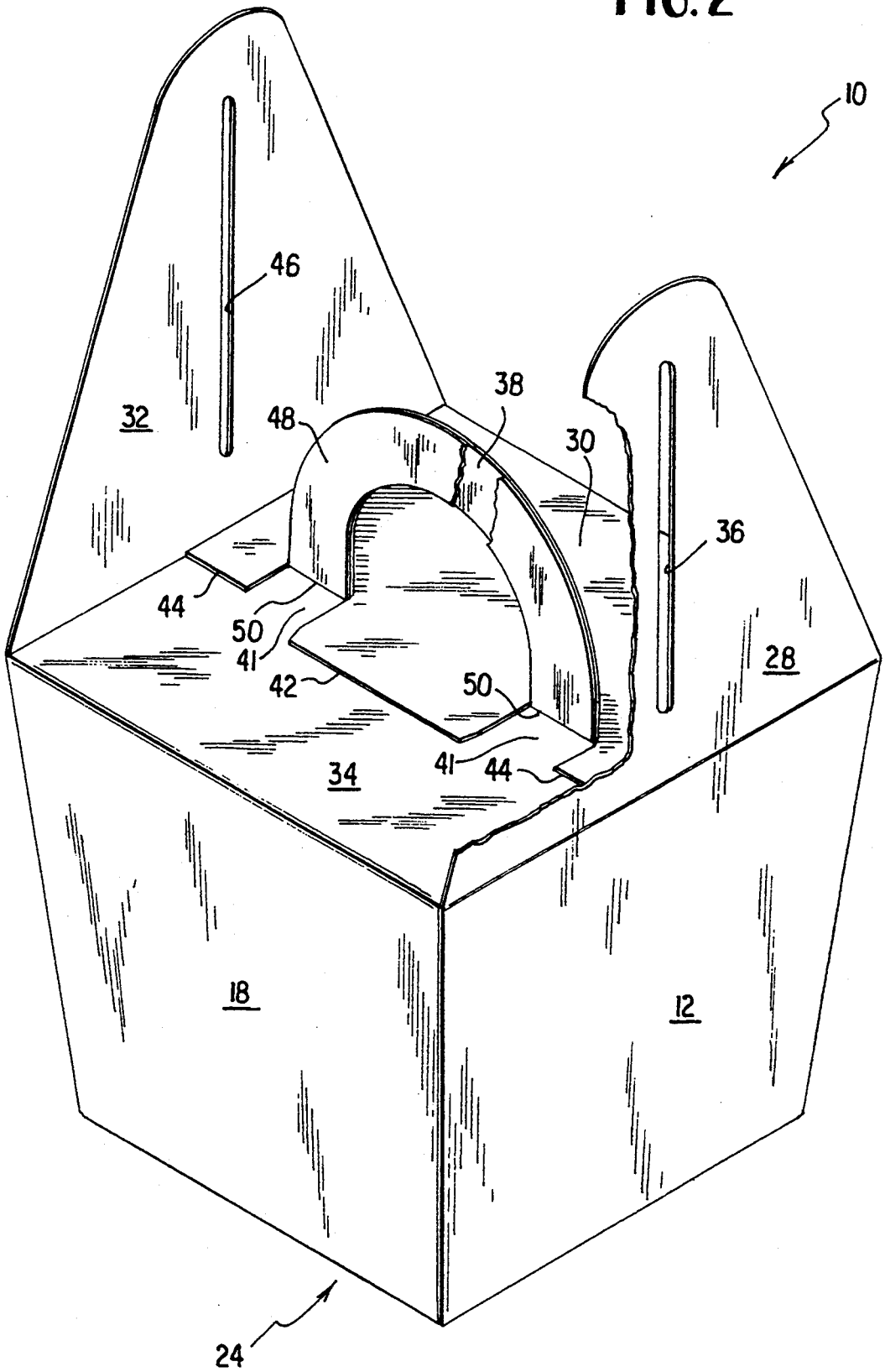
FIG. 2 is a partially broken perspective view illustrating the blank of FIG. 1 folded and partially closed.

Referring now to FIG. 2, the blank of FIG. 1 has been folded along the indicated fold lines, and the bottom closure panels 24 have been closed to form a bottom for the container, with flap 20 glued to sidewall 18 either internally or externally. Typically, a fast food product is placed in the container and bottommost inner top closure panel 34 folded downwardly to a generally horizontal position and its handle 48 bent upwardly. Then, topmost inner top closure panel 30 is also folded down to a generally horizontal position and it handle 38 bent upwardly, the arrangement being such that handles 38 and 48 become engaged in surface to surface contact, also as may be seen by the broken portion of the middle of handle portion 48. Edge 42 of closure panel 30 extends through the opening formed between the ends of the two handles 38 and 48, with lateral free edges 44, together with edge 42, lying on the top of panel 34. Upon upward bending of the two handles, spaced slots 41 are formed at the free edges of topmost inner closure panel 30. These spaced slots receive the lowermost composite handle portions. The free edges 42 and 44 of closure panel 30 overlie free edges 35 of closure panel 34 so that there is a partial overlapping of panels 30 and 34.

Figure 3:
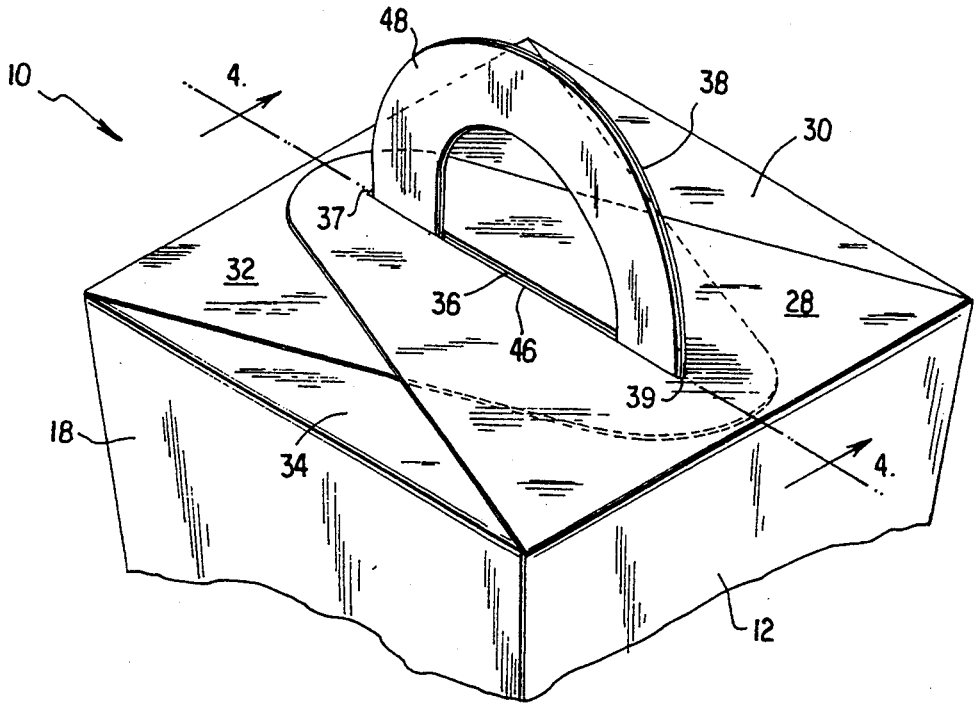
FIG. 3 is a view similar to FIG. 2 and illustrates the final configuration of the top closure panels.
Figure 4:
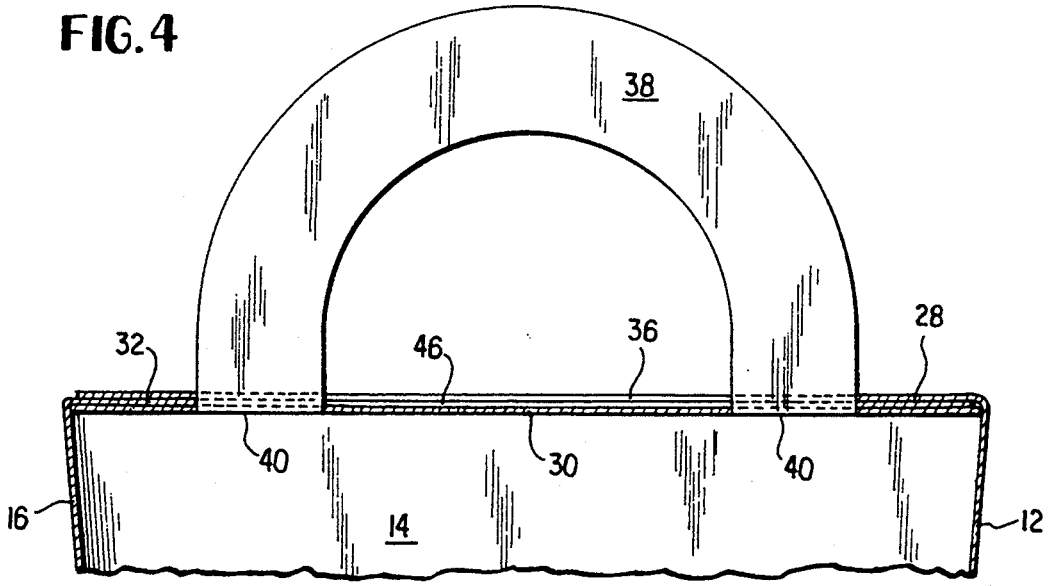
FIG. 4 is a view taken along section 4—4 of FIG. 3.

Referring now to FIG. 3, triangular closure panels 28 and 32 are now folded inwardly, in sequence, such that one of them overlies the other, with slits 36 and 46 being aligned. Panels 28 and 32 lie flat against each other and on top of panels 30 and 34.

Still referring to FIG. 3, the relationship between the length of slits 36 and 46 and the outer diameter of semicircular handles 38 and 48 is such that when triangular closure panels 28 and 32 are folded from the position shown at FIG. 2 to the position shown at FIG. 3, there is substantial frictional contact between the ends 37, 39 and 47, 49 of respective slits 36 and 46 and the outermost edge surfaces of the handles, where the latter extend upwardly from the top of the closed container.

This frictional contact functions to maintain the closed condition of the container by inhibiting upward swinging of top closure panels 30, 34, 32, and 28.

The container construction of this invention exhibits particular utility in Chinese carry out food wherein if not all of the food is consumed initially, the remainder may be left in the container, refrigerated, and then reheated in a microwave oven. This is in distinction to common Chinese or other carry out food containers which employ a metal handle or bail. The frictional latching action arises from a slight resilient deformation of the slit ends/handle ends in the configuration of FIG. 3 due to the resiliency of the paperboard.

Geometrical terms of orientation such as upper, vertical, and the like as employed to facilitated a description of the invention and are not intended as limiting.

I claim:

1. A unitary blank of paperboard for forming a container having a top handle, said blank including four sidewall forming panels foldably and serially joined to each other along respective side edges thereof, each of said sidewall forming panels having an upper edge and a lower edge, said four sidewall forming panels being of the same vertical extent, said lower edges of said sidewall forming panels provided with respective container bottom forming panels, said upper edge of a first of said sidewall forming panels having foldably secured thereto a first generally rectangular inner top closure panel, said first inner top closure panel having a first edge opposite to said first sidewall forming panel, said first edge having a first semicircular handle foldably attached thereto, said upper edge of a second of said sidewall forming panels having foldably secured thereto a first generally triangular outer top closure panel, said first generally triangular outer top closure panel having a generally vertical closed slit, said upper edge a third of said sidewall forming panels having foldably secured thereto a second generally rectangular inner top closure panel, said second inner top closure panel having a second edge having three spaced apart free edge segments opposite to said third sidewall forming panel, said second generally rectangular inner top closure panel having a second semicircular handle foldably attached thereto below said three free edge segments, said three free edge segments each being spaced from said third sidewall forming upper edge a greater distance than said first edge of said first generally rectangular inner top closure panel is spaced from said upper edge of said first sidewall forming panel, said second generally rectangular top closure panel having spaced slots terminating between respective next adjacent pairs of said three free edge segments, said second semicircular handle having ends extending into said spaced slots, said upper edge of a fourth of said sidewall forming panels having foldably secured thereto a second generally triangular outer top closure panel, said second generally triangular outer top closure panel having a generally vertical closed slit.

2. The blank of claim 1 wherein said sidewall forming panels are trapezoidal in form.

3. A container formed from a unitary blank of paperboard, said container having four sidewalls and a bottom closure, each of said sidewalls having an upper edge, each said sidewall having a top closure panel foldably secured to a respective said upper edge thereof, two of said closure panels being inner top closure panels and being opposite to each other and having respective edges, each of said two inner top closure panels having a respective semicircular handle foldably attached thereto at a respective said edge and defining handle top closure panels, said two opposite inner top closure panels being partially overlapped, the remaining said two closure panels each having a respective closed slit therein and being overlapped and located above said two inner top closure panels and their respective closed slits being aligned and receiving said handles, respective ends of said slits being in frictional contact with said handles to maintain all of said top closure panels closed.

4. The container of claim 3 wherein one of said two inner top closure panels has its said edge segmented to define two spaced slots therealong, said slots having edge one of said handles foldable extending from respective ones of said slot edges, said one of said two inner top closure panels having said spaced slots having its said segmented edge overlying a portion of said other inner top closure panel.

5. The container of claim 3 wherein said two top closure panels having said respective semicircular handles are generally rectangular.

6. The container of claim 3 wherein said top closure panels having said slits are generally triangular.

7. The container of claim 3 wherein said sidewall panels are trapezoidal to thereby define a container of generally truncated right four sided pyramidal form, said container having a largest end and a smallest end, said handles located at said largest end.

* * * * *